United States Patent [19]

Schnier

[11] 4,264,232

[45] Apr. 28, 1981

[54] METHOD AND DEVICE FOR ASSEMBLING A LAYER OF CONCRETE PAVING BRICKS FORMING A BRICK DISK IN THE FORM OF A STRETCHER BOND WHICH MAY BE USED AS ONE SETTING UNIT

[75] Inventor: Egon Schnier, Höfen, Fed. Rep. of Germany

[73] Assignee: Firma Axel Holger Lehnen, Vermietung-Verpachtung-Leasing, Duisburg-Baerl, Fed. Rep. of Germany

[21] Appl. No.: 96,352

[22] Filed: Nov. 21, 1979

[51] Int. Cl.[3] ..... E01C 5/04

[52] U.S. Cl. ..... 404/73; 404/99; 414/623

[58] Field of Search ..... 404/99, 73; 52/749; 414/450, 736, 453, 741, 454, 451, 455, 486, 621, 623

[56] References Cited

U.S. PATENT DOCUMENTS

| | | | |
|---|---|---|---|
| 3,092,274 | 6/1963 | Harris | 414/621 X |
| 3,259,260 | 7/1966 | Blair | 414/741 |
| 3,478,898 | 11/1969 | Graham | 414/621 X |
| 3,987,905 | 10/1976 | Dechantsreiter | 414/623 X |
| 4,194,853 | 3/1980 | Barth | 404/99 X |

FOREIGN PATENT DOCUMENTS

| | | | |
|---|---|---|---|
| 2823233 | 11/1979 | Fed. Rep. of Germany | 404/99 |

*Primary Examiner*—Nile C. Byers, Jr.

*Attorney, Agent, or Firm*—Allison C. Collard; Thomas M. Galgano

[57] ABSTRACT

A method and device for collecting a layer of concrete paving bricks forming a brick disk in the form of a stretcher bond which may be used as one setting unit, is characterized in that the layer of the paving bricks is clamped together laterally with a collecting clamp with respect to their longitudinal axes for aligning purposes and, after releasing the collecting clamps, each row of bricks is individually clamped to their respective position at their head ends with clamps. The clamps with the clamped rows of bricks are then displaced with respect to each other in a parallel direction to achieve the desired setting arrangement and the collecting clamp is again engaged.

12 Claims, 3 Drawing Figures

METHOD AND DEVICE FOR ASSEMBLING A LAYER OF CONCRETE PAVING BRICKS FORMING A BRICK DISK IN THE FORM OF A STRETCHER BOND WHICH MAY BE USED AS ONE SETTING UNIT

The invention relates to a method of assembling a layer of concrete paving bricks or stones forming a brick disk in the form of a stretcher bond and a device for carrying out the method, as well as for setting the brick disk as a setting unit.

Rectangular paving bricks made of concrete may be pressed together in layers and into brick disks which may be used as setting units, provided that the prerequisite of a sufficiently high clamping force is met. Normally the layer which is formed from individual bricks is pressed together at all four sides by a corresponding clamping pressure.

Due to measurement deviations of a brick which may be located in the center of the brick disk, it is possible that one or a plurality of smaller bricks may fall out of the clamped bond of the brick disk. The clamping of the brick disk on all sides is also disadvantageous in that the use of the brick disk is not useable as a setting unit in the case that a setting pattern of the paving bricks is desired, for example, a stretcher bond.

The solution to this problem would be to make the paving bricks in the form of stretcher bonds. However, the disadvantage is that for each forming operation 15–25 less bricks can be used.

It is therefore an object of the invention to find a method which permits a regrouping of a layer of bricks into a stretcher bond which can be used in such a form as a brick disk and a setting unit, as well as a device for carrying out the method.

This object of the invention is obtained in accordance with the present invention by the provision of the method wherein, initially, the layer of the paving bricks is clamped together laterally with a collecting clamp or clamps with respect to the longitudinal axes of the bricks and, after releasing the collecting clamp, each row of bricks is individually clamped in their desired position at their head or longitudinal ends. The clamps with the clamped rows of bricks are then displaced with respect to each other in a parallel direction, and the collecting clamp is again engaged.

The first method step assures an exact alignment of a layer of paving bricks into the initial position from which an exact stretcher bond is to be shaped. Thereafter, each row of bricks is individually clamped together in a longitudinal direction and the rows of bricks are displaced into the desired stretcher bond with their associated clamps, after the collecting clamp is released. As soon as the individual rows of bricks with their associated clamps are displaced into the desired stretcher bond, for example, in a stretcher bond by about half a brick, the collecting clamp may again be engaged. Thereby, a sagging of the individually clamped rows of bricks, as soon as lifting occurs, is avoided, thereby permitting transport of the setting unit, which is formed by a plurality of bricks, to the intended setting site.

In accordance with a further embodiment of the invention, a device is provided for carrying out the method of the invention which is characterized in that two parallel supporting arms are detachably mounted on a hoisting device, which arms are provided at one longitudinal end with a clamping bar for the brick disk to be shaped and at the opposite end with actuable clamping means which engage the bricks and retain the bricks in a collected manner. A plurality of spaced-apart, parallel support legs for each row of bricks are each fixedly coupled to one of the support arms and slidably coupled to the other support in a successive alternate manner so as to permit sliding parallel movement of the support legs with respect to one another and over each row of paving bricks. A hydraulic displacement cylinder for changing the distance between the support arms and support legs is provided. Clamping members are disposed at each end of the support legs and at least one of the clamping members of each support leg is operatively coupled with an actuating means.

The inventive device is of simple construction and consists of only a few individual parts. Conventional Bowden cables are used as actuating means for each of the moveable clamping members of each support leg. All Bowden cables of the clamping members are simultaneously actuated by one operating cylinder. The actuation of the clamping members for the rows of bricks by means of Bowden cables is advantageous in that the displacement of the clamping members for forming the desired bond shape of the paving brick setting is constructively very simple since the Bowden cables can easily follow the displacement movement. Furthermore, Bowden cables are advantageous in that they have a lower weight with respect to levers and rods, which has a favorable effect on the setting operation.

Furthermore, the Bowden cables are advantageous because they can engage in tight relationship with the neutral axis of the support legs and the clamping members, so that the forces required for clamping can be brought onto the support legs with very low bending moments. Therefore, when laying out the structural parts, the side effects of the bending forces created by the clamping forces can be disregarded. This is particularly advantageous for saving weight for the construction of the device.

In a preferred embodiment of the invention, each clamping member is provided with a roller element which is in engagement with the brick surface. The roller elements permit a slight lateral movement with respect to the clamping direction of the support legs after clamping the individual rows of bricks, so that during the setting of the clamped rows of bricks, as well as during the last lateral clamping into a disk, a required lateral movement of the rows of bricks can take place, as a result of which a bending of the supports or a damaging of the bricks by the clamping forces is avoided.

The clamping of the individual rows of bricks also has the advantage that lateral joints remain in the bricks which facilitate the setting and fitting into already set bricks. This is achieved in accordance with the operating principle of the length adjustment of the support legs, whereby each end of each support leg has a longitudinally moveable part carrying the clamping member which is telescopically moveable with respect to the support leg by means of the Bowden cable. The mounting of the telescopically moveable clamping members by means of the Bowden cable facilitates the desired advantageous characteristic of the construction of avoiding bending moments created by the clamp forces. The actuable brick clamping means for the collective clamping is disposed on a clamp shaft supported at the opposite end of the support arms in a parallel manner with respect to the clamp bar. By a simple turning of the clamp shaft, the brick clamping means can be brought into snug engagement with the brick surfaces.

In a preferred embodiment of the device, the clamp bar and the clamp shaft are each provided with a centrally-disposed clamping jaw which is mounted between the support arms. Thereby, the lateral pressing of the individual rows of bricks is carried out in the center of the brick disk, while at the edge the required joints are present, which facilitate the fitting of the paving bricks in already set rows of bricks. In addition to the clamping jaws, alignment jaws are provided on the clamp shaft which, during the collecting clamping at the start of the operation, merely fulfill a collecting and aligning function.

A simple operating cylinder is provided for rotating the clamp shaft. Simple detachment means may be provided for the hoisting means which is characterized in that the detachment means at each support arm is provided with hinged yokes, the free ends of which are coupled with a detachment eyelet by means of a ball and socket pivot joint. By means of the ball and socket joints, the distance adjustment between the support arms may be balanced during displacement of the individual support legs.

Other objects and features of the present invention will become apparent from the following detailed description, considered in connection with the accompanying drawings, which discloses a single embodiment of the invention. It is to be understood, however, that the drawing is designed for the purpose of illustration only, and not as a definition of the limits of the invention.

In the drawings, wherein similar reference characters denote similar elements throughout the several views.

Figure 1:
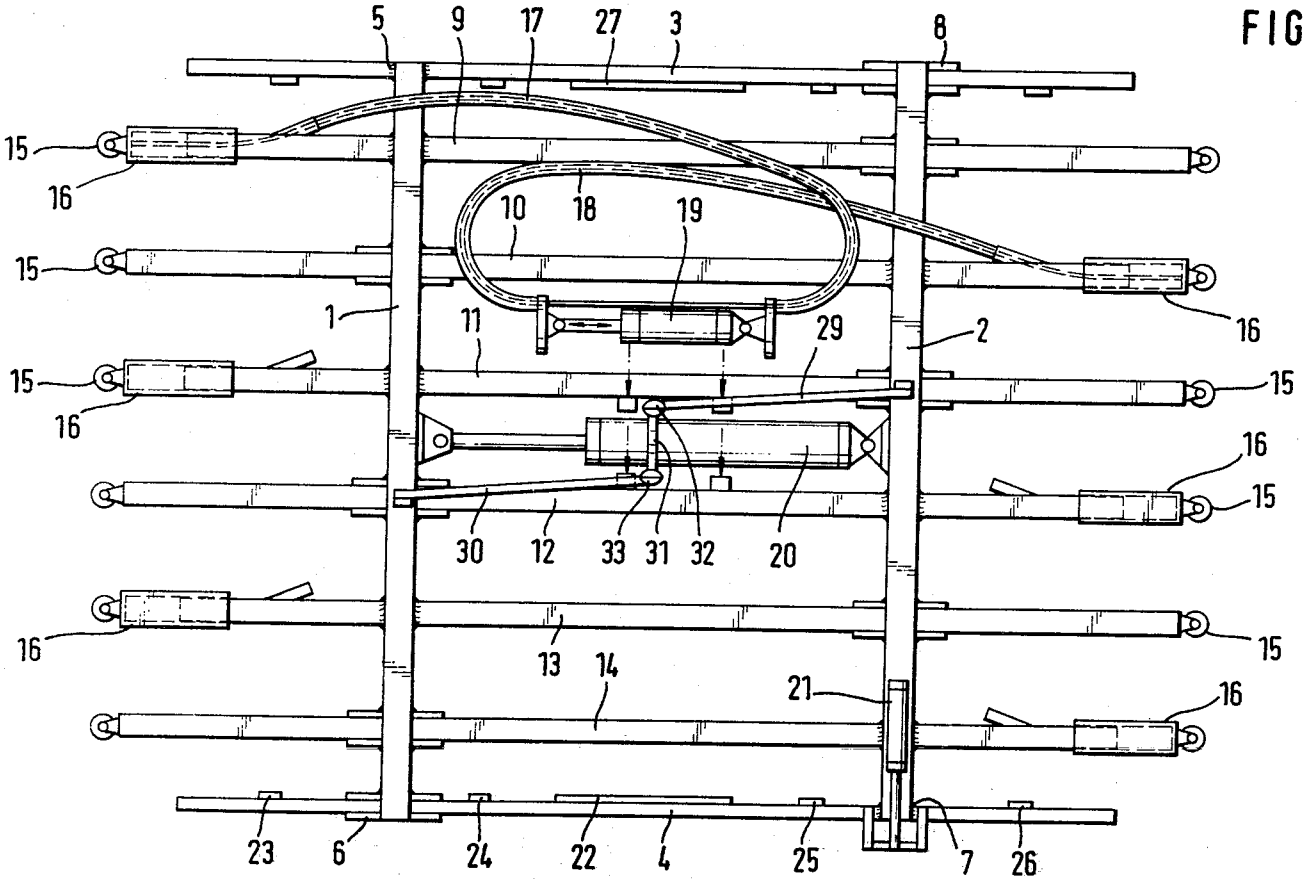
FIG. 1 is a schematically-illustrated plan view of a device embodying the present invention.

Referring now in detail to the drawings, FIG. 1 illustrates a schematic plan view of the device according to the invention for clamping and aligning a brick disk which is useable as a setting unit. Two parallel support arms 1 and 2 carry at their opposite ends a clamp or clamping bar 3 and a clamp or clamping shaft 4. Support arm 1 is fixedly coupled at one end to the clamp bar 3 by the shown welding seams 5, and clamp shaft 4 is guided in a schematically-illustrated slide bearing 6 at the opposite end thereof. Support arm 2 is fixedly coupled at one end of clamp shaft 4 by welding seams 7 and clamp bar 3 is guided, on this support arm 2 at the opposite end thereof, by the schematically-illustrated slide bearing 8.

Support legs 9–14 are disposed laterally with respect to support arms 1 and 2 and the ends of these support legs are provided with (schematically shown) clamping members having associated roller elements 15. Adjacent support legs are provided at their opposite ends with telescopic, longitudinally-displaceable jackets 16 which carry the clamping members. Support leg 9 is welded to support arm 1 and is guided in a guide bearing on support arm 2. However, the adjacent support leg 10 is guided in a slide bearing on support arm 1 and is welded to support arm 2. In accordance with this alternating arrangement, all other support legs are arranged in the same manner. The jackets 16 together with the clamping members of the two support legs 9 and 10 are coupled by Bowden cables 17 and 18. Both Bowden cables have a common core, the ends of which are mounted on the jackets 16 of the adjacent support legs. The tensioning of the rope cables and thereby the clamping action of the clamping members is carried out by a clamping cylinder 19.

In order to maintain the clarity of the drawings, only the two Bowden cables associated with support legs 9 and 10 are shown. Naturally, Bowden cables are present in the device which lead to the jackets 16 of support legs 11, 12, 13 and 14.

Figure 2:
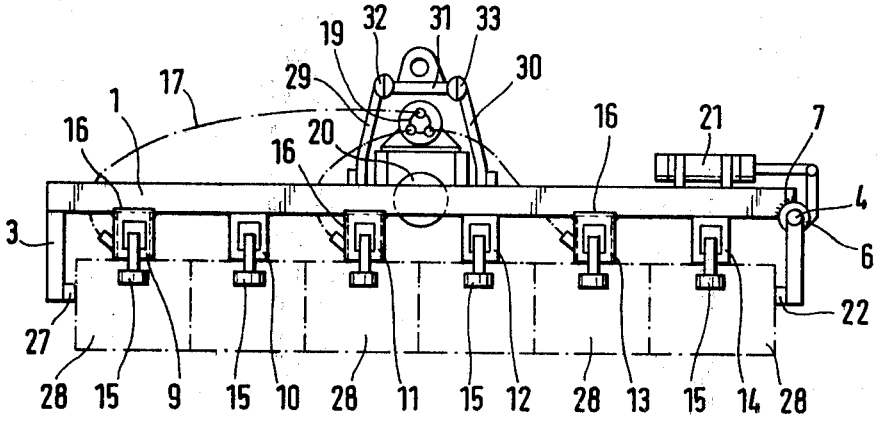
FIG. 2 is a side view of the device shown in FIG. 1.

In the center of the device, a displacement cylinder 20 is provided which is supported on support arm 2. Cylinder 20 has a piston rod which engages support arm 1. By dash dotted lines (arrows), it is indicated that clamping cylinder 19 is provided above displacement or slide cylinder 20, as shown in FIG. 2. This type of drawing was chosen so as not to cover the displacement cylinder. By means of the displacement cylinder, the distance between the support arms 1 and 2 can be changed, whereby the fixedly mounted support legs are also displaced.

A third operating cylinder 21 is provided which pivots clamp shaft 4. Clamp shaft 4 is provided with a center clamping jaw 22 and laterally arranged alignment jaws 23, 24, 25 and 26. Similarly, clamping bar 3 is provided with a clamping jaw 27 disposed at a point opposite to that of the clamping jaw 22 of clamping shaft 4.

FIG. 2 is a schematically-illustrated side view of the device shown in FIG. 1. From FIG. 2 it can be seen that the total device can be placed over the total brick layer which consists of paving bricks 28. Hinged rods 29 and 30 are hingably supported on the support arms, and are coupled by means of ball and socket joints 32 and 33 to a suspension eyelet 31.

Figure 3:
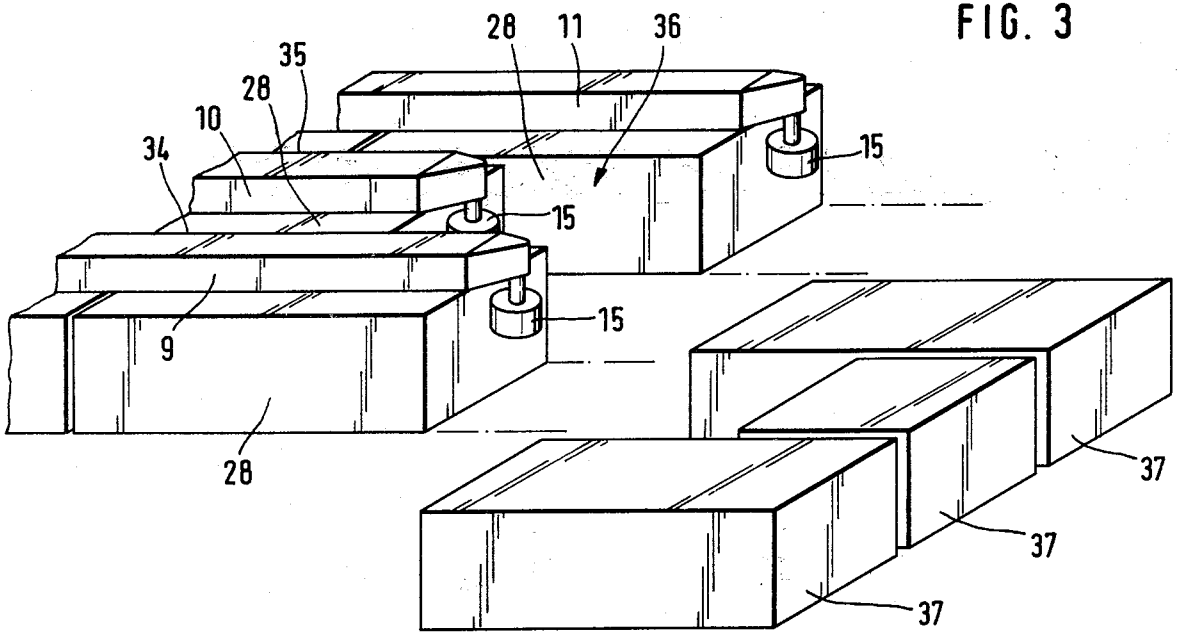
FIG. 3 is a schematically-illustrated perspective view of a section from the edge portion of a clamped brick disk shortly before the same is set adjacent to previously set units.

FIG. 3 is a sectional view of a brick disk 28, whereby the individual rows or courses of the bricks of the disk are retained, for example, by support legs 9, 10, 11 and the associated roller elements 15 which engage the bricks and which are displaced in such a manner that a setting unit is formed in the stretcher bond.

By clamping the individual courses of bricks with the clamping jaws 27 and 22 as shown in FIGS. 1 and 2, it is advantageous that the joints 34 and 35 between the courses of bricks are not pressed together but are still relatively wide and changeable. The disposition of the support legs which are displaceable relative to each other and their associated roller elements 15 is also advantageous in that, when setting the area 36 (indicated by the arrow in FIG. 3), it can be easily viewed from above. Thereby, the setting operation is facilitated. The reference numeral 37 depicts already set bricks.

While only a single embodiment of the present invention has been shown and described, it will be obvious that many modifications and changes may be made therein, without departing from the spirit and scope of the invention.

What is claimed is:

1. A method of assembling a layer of concrete paving bricks forming a brick disk in the form of a stretcher bond which may be used as one setting unit, comprising the steps of:

aligning a layer of bricks comprising successive rows of bricks in a desired longitudinal direction by clamping said layer of bricks together laterally by means of at least one collecting clamp;

after releasing said collecting clamp, individually clamping each row of bricks at their longitudinal ends by means of clamping members;

displacing the clamping members and their associated clamped row of bricks in a parallel longitudinal direction with respect to the other clamping members and their associated clamped row of bricks so as to arrange said rows in a desired setting pattern; and clamping said layer of bricks together laterally by means of said at least one collecting clamp.

2. A device for assembling a layer of concrete bricks forming a brick disk in the form of a stretcher bond which may be used as one setting unit, comprising:

a pair of spaced-apart, parallel support arms including means for detachably mounting said support arms on a hoisting device and a clamping bar coupled to one end of said support arms and actuable clamping means coupled to the opposite ends of said support arms which cooperate with said clamping bar to engage and retain the layer of bricks in an assembled manner;

a plurality of spaced-apart, parallel support legs coupled to and disposed generally normally to said support arms, said support legs each being fixedly coupled to one of said support legs and slidably coupled to the other of said support legs in a successive alternate manner so as to permit displacement of said support legs in a parallel manner with respect to each other and over a row of paving bricks of the brick disc, said support legs each having clamping members disposed at the opposite ends thereof, at least one of which is moveable; and actuating means operatively coupled to at least one of the clamping members of each support leg.

3. The device according to claim 2, wherein said actuating means includes a conventional Bowden cable for each moveable clamping member of each support leg.

4. The device according to claim 3, wherein said actuating means includes an operating cylinder for simultaneous actuation of each of said Bowden cables.

5. The device according to claim 2, 3, or 4, wherein each of said clamping members includes a roller element which is engageable with a brick surface.

6. The device according to claim 2, 3, or 4, wherein each actuable clamping member is telescopically moveable with respect to its associated support leg by means of each of said Bowden cables.

7. The device according to claim 2, wherein said actuable clamping means for the collective clamping of the bricks is disposed on a clamping shaft which is mounted on the other ends of said support arms in a parallel manner with respect to said clamping bar.

8. The device according to claim 7, wherein said clamping bar and said clamping shaft each have a clamping jaw mounted at the center thereof between said support arms opposing one another.

9. The device according to claim 8, additionally including a plurality of alignment jaws disposed on said clamping shaft, laterally of said clamping jaw mounted thereon.

10. The device according to claim 7, additionally including an operating cylinder coupled to said clamping shaft for rotating said clamping shaft between an operative and inoperative position.

11. The device according to claim 2, wherein said means for detachably mounting comprises hinged yokes coupled to each of the support arms having free ends which are coupled with a detachment eyelet by means of a ball and socket pivot joint.

12. The device according to claim 2, wherein said support arms and support legs have clamping members made of pipe profiles.

* * * * *